US007520269B2

(12) United States Patent
Stewart et al.

(10) Patent No.: US 7,520,269 B2
(45) Date of Patent: Apr. 21, 2009

(54) FUEL INJECTOR NOZZLE ASSEMBLY

(75) Inventors: Ted Stewart, Ponte Vedra Beach, FL (US); James Napier, Atlantic Beach, FL (US)

(73) Assignee: Advanced Global Equities and Intellectual Properties, Jacksonville, FL (US)

( * ) Notice: Subject to any disclaimer, the term of this patent is extended or adjusted under 35 U.S.C. 154(b) by 146 days.

(21) Appl. No.: 11/475,559

(22) Filed: Jun. 27, 2006

(65) Prior Publication Data

US 2007/0290077 A1 Dec. 20, 2007

Related U.S. Application Data

(60) Provisional application No. 60/694,497, filed on Jun. 28, 2005.

(51) Int. Cl.
*F02M 61/14* (2006.01)
*F02M 61/18* (2006.01)

(52) U.S. Cl. ..... 123/470; 123/467

(58) Field of Classification Search ..... 123/467, 123/468, 469, 470; 239/533.12, 533.2, 533.7, 239/506, 453

See application file for complete search history.

(56) References Cited

U.S. PATENT DOCUMENTS 2,753,217 A * 7/1956 Pccora, Jr. et al. ..... 239/453
4,197,997 A * 4/1980 Wu et al. ..... 239/453
4,408,722 A * 10/1983 Frelund ..... 239/453
5,546,902 A * 8/1996 Paluch et al. ..... 123/304
6,105,879 A * 8/2000 Potz et al. ..... 239/88
6,340,017 B1 * 1/2002 Dick ..... 123/467
6,474,565 B1 * 11/2002 Ruehle et al. ..... 239/102.1
6,484,699 B2 * 11/2002 Paul et al. ..... 123/525
6,612,508 B2 * 9/2003 Lambert ..... 239/533.12
6,676,040 B2 * 1/2004 Park ..... 239/463
7,137,571 B2 * 11/2006 Caley et al. ..... 239/132
7,185,832 B2 * 3/2007 Kaden et al. ..... 239/533.7
2001/0032893 A1 * 10/2001 Lambert ..... 239/533.3
2002/0145060 A1 * 10/2002 Mills et al. ..... 239/585.1
2003/0012985 A1 * 1/2003 McAlister ..... 429/12
2004/0021015 A1 * 2/2004 Murdoch ..... 239/533.12
2004/0164175 A1 * 8/2004 Maeurer et al. ..... 239/102.2
2005/0150978 A1 * 7/2005 Kaden et al. ..... 239/453

* cited by examiner

*Primary Examiner*—Mahmoud Gimie
(74) *Attorney, Agent, or Firm*—Schmid PA

(57) ABSTRACT

Disclosed is a fuel injection nozzle assembly comprising a poppet type valve assembly capable of producing a circumferential spray pattern. The fuel injection nozzle assembly includes a nozzle body defining a valve outlet into which is fitted a needle valve having a flanged portion extending from the nozzle body. The flanged portion opens and closes the valve outlet as the needle valve travels up and down the nozzle body as dictated by the fuel pressure within the nozzle body. The flanged portion may further direct the fuel spray into a combustion chamber.

20 Claims, 6 Drawing Sheets

FUEL INJECTOR NOZZLE ASSEMBLY

CROSS-REFERENCE TO RELATED APPLICATION

This application claims priority to U.S. Provisional Patent Application Ser. No. 60/694,497 filed Jun. 28, 2005, the contents of which are hereby incorporated in their entirety.

FIELD OF THE INVENTION

The present invention generally relates to a fuel injection system and more specifically the invention relates to an apparatus and method for injecting a fuel plume into a combustion chamber via a singular gap formed between a flanged portion of a needle valve and a valve seat.

BACKGROUND

The conventional combustion process in a diesel engine is initiated by the direct injection of fuel into a combustion chamber containing compressed air. The fuel is essentially ignited instantaneously upon injection into a highly compressed combustion chamber, and thus produces a diffusion flame or flame front extending along the plumes of the injected fuel. The fuel is directly injected into the combustion chamber by a fuel injector having a perforated nozzle tip extending into the combustion chamber. The nozzle tip may extend slightly into the combustion chamber from a wall of the chamber located opposite a reciprocating piston of the combustion chamber. The nozzle tip comprises a series of holes from which fuel is extruded into the combustion chamber.

Nozzle tips are commonly designed with the largest number of spray holes having the smallest diameter possible to inject the required fuel quantity at each locomotive engine's speed and load setting in order to preserve the nozzle's wall thickness and strength.

Diesel fuel is injected at 10,000-18,000 psi out through 5 to 7 individual, separate and distinct round orifice holes located at the very bottom of the spray tip. The resultant spray pattern consists of separate and distinct solid plumes of atomized fuel droplets that evaporate and mix with the combustion air at the proper temperature, pressure and air/fuel ratio auto-ignite.

The spray holes are the first components of the injector assembly to ultimately affect the service life and durability of the nozzle assembly. Typically, a spray tip's fuel flow characteristics deteriorate approximately 0.5% per year for the first three years, increasing rapidly to 1% to 1.5% per year by a service life of 5 and 6 years. The service life and long term durability of the whole geometry is strictly a function of the total fuel consumed or injected through each of the spray holes.

The fuel plumes after an extended service life become less of an atomized and turbulent gaseous spray pattern and become more like a solid laminar fuel stream taking more time to break up into small droplets, evaporate and burn. The ignition of a gaseous spray is much more efficient than that of a solid stream of fuel.

In an effort to overcome such short comings, spay tip orifices require very precise machining at great expense. The manufacture of such spray tips requires the creation of spray holes, which must be perfectly round having a precise diameter in order to provide the correct geometry for the proper fuel flow and atomization. Such spray holes require a certain case hardness depth to help prevent premature wear and erosion. This hardening process is very critical. If the case depth is too shallow, the hole will wear prematurely and if too hard will become brittle, the hole will be prone to stress fractures and premature failures.

Thus, what is needed is a method and apparatus capable of providing a durable spray assembly that can deliver a consistent atomized spray plume over the service life of a fuel injector.

SUMMARY

The present invention generally relates to a fuel injection nozzle assembly and in particular the invention relates to a poppet type valve assembly capable of producing a circumferential spray pattern. The circumferential spray pattern can maximize the contact surface area and optimize the air and fuel mixture within the combustion chamber.

In greater detail, the fuel injector nozzle assembly includes a nozzle body defining a valve outlet including a valve seat and a longitudinal axis. The needle valve includes a first and second end wherein the needle valve is slidably affixed and housed within the nozzle body about the longitudinal axis. The second end of the needle valve extends though the valve outlet and past the valve seat. A flanged portion is formed at the second end to the needle valve for directing a fuel plume and closing the valve outlet.

The fuel injector nozzle assembly may also include indications about the outside circumference of the needle valve for providing rotational motion as fuel is passed down and along the needle valve. The flanged portion produces a circumferential spray pattern and includes sloping edges for directing a fuel stream into a combustion chamber.

A further embodiment includes a direct fuel injection combustion chamber assembly including a combustion chamber and a piston forming a moving end wall of the combustion chamber. The fuel injector includes a nozzle assembly in communication with the combustion chamber. The nozzle assembly includes a nozzle body defining a valve outlet including a valve seat and a longitudinal axis. The needle valve has a first and second end wherein the needle valve is slidably affixed and housed within the nozzle body about the longitudinal axis with the second end extending though the valve outlet and past the valve seat. A flanged portion formed at the second end of the needle valve and is in communication with the valve seat.

An additional embodiment includes a method of injecting fuel into a combustion chamber. The method includes injecting fuel into a fuel injector nozzle assembly. The method further includes forming a gap between a flanged portion of a needle valve and a valve seat formed on the exterior of a nozzle body. The method further includes forming the gap at a certain fuel pressure created by the injection of the fuel into the fuel injection nozzle assembly. A quantity of fuel is injected out of the formed gap and into the combustion chamber and the formed gap closes as the fuel pressure decreases. The fuel may be ejected in a circumferential spray pattern.

DRAWINGS

DETAILED DESCRIPTION

Disclosed is a fuel injection nozzle assembly comprising a poppet type valve assembly capable of producing a circumferential spray pattern. The fuel injection nozzle assembly includes a nozzle body defining a valve outlet into which is fitted a needle valve having a flanged portion extending from the nozzle body. The flange portion open and closes the valve outlet as the needle valve travels up and down the nozzle body as dictated by the fuel pressure within the nozzle body. The flanged portion directs a fuel spray into a combustion chamber.

The substantially circumferential spray pattern of the present assembly increases the number of possible ignition points over the full cone-shaped sheet of diesel fuel. The term "substantially circumferential" and "circumferential" are defined herein to include spray patters having radiuses of between about 365 to about 250 degrees. An increased number of ignition points significantly improves the fuel's combustion efficiency. The thin cone-shaped plume produced by the assembly is conducive to rapid fuel droplet evaporation, thus promoting a significant increase in the number of areas reaching the correct air/fuel ratio necessary to initiate the start of ignition in a diesel engine's combustion process.

A further advantage of the present assembly is the lack of significant corrosion within the injection gap. Orifice spray holes are prone to erosion, wear and corrosion due to their size, manufacturing process and nozzle material characteristics. The single opening injection gap of the present assembly can be manufactured and produced from significantly harder materials combined with an additional surface hardening process to produce higher surface hardness levels.

Additionally, the geometry of the single opening injection gap distributes the fluid forces evenly about the contact surfaces. Deterioration of the nozzle spray hole geometry is directly related to the amount of fuel consumed, with a resultant decrease in fuel economy and emissions. An additional advantage of the present assembly includes opportunities to lower manufacturing and assembly costs due to the simpler manufacturing design of the nozzle assembly.

Referring now in greater detail to the drawings in which like numerals indicate like parts throughout the several views, FIGS. 1-6 depict the fuel injector nozzle assembly in various embodiments of the present invention.

Figure 1:
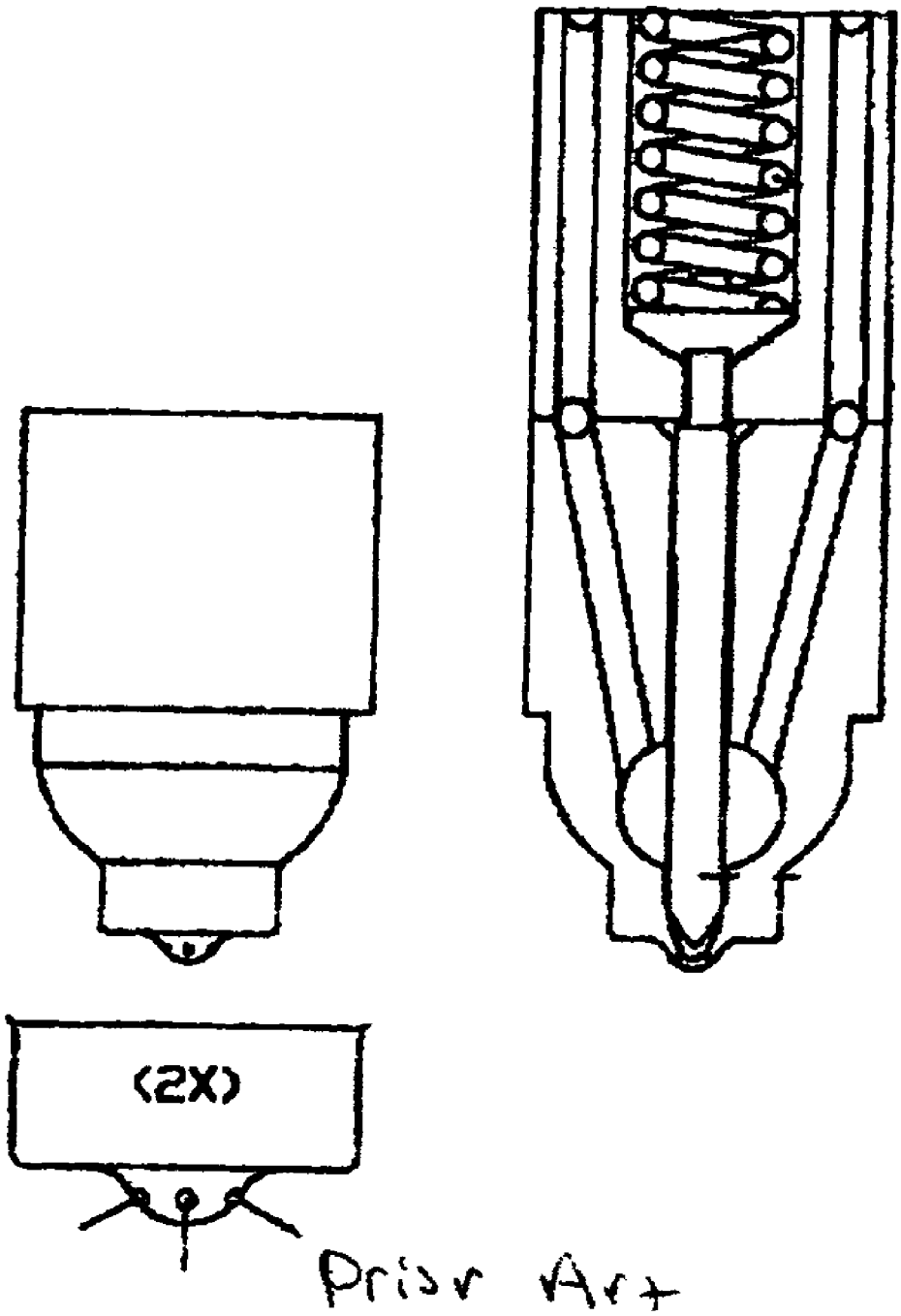
FIG. 1 illustrates an embodiment of the known art comprising a conventional needle valve and spray nozzle including a plurality of orifices which are engaged and filled with fuel upon the lifting of the needle valve.

FIG. 1 illustrates the known art configuration for a fuel injection nozzle assembly. The known art nozzle spray tip design involves five separate components; the spray tip including orifice holes, the needle valve, the valve spring, the valve spring seat and the valve spring cage.

During the injection event, the injector's plunger is pushed downward by the camshaft lobe creating a significant increase in the fuel supply pressure and flow through the end of the plunger bushing, around and through the check valve cutouts, down through the multiple flow passages of the check valve cage, the valve spring cage, and the spray tip itself, and finally into the spray tip's fuel cavity. The spray tip's fuel cavity is sealed by the needle valve seat angle contacting a matching seat angle inside the spray tip. The needle valve is held in place by the valve spring and valve spring seat.

As the fuel supply pressure increases, it exerts pressure on the needle valve to lift up off its seat. Once the fuel supply pressure exceeds 3400-3000 psi, the needle is lifted and pushed up against the valve spring and the fuel is then injected down through the spray tip fuel sac and out through the orifice holes. Once the pressure drops below 3400-3000 psi, the needle then closes and reseats on the spray tip's seat angle preventing any possibility of a secondary injection event.

Figure 2:
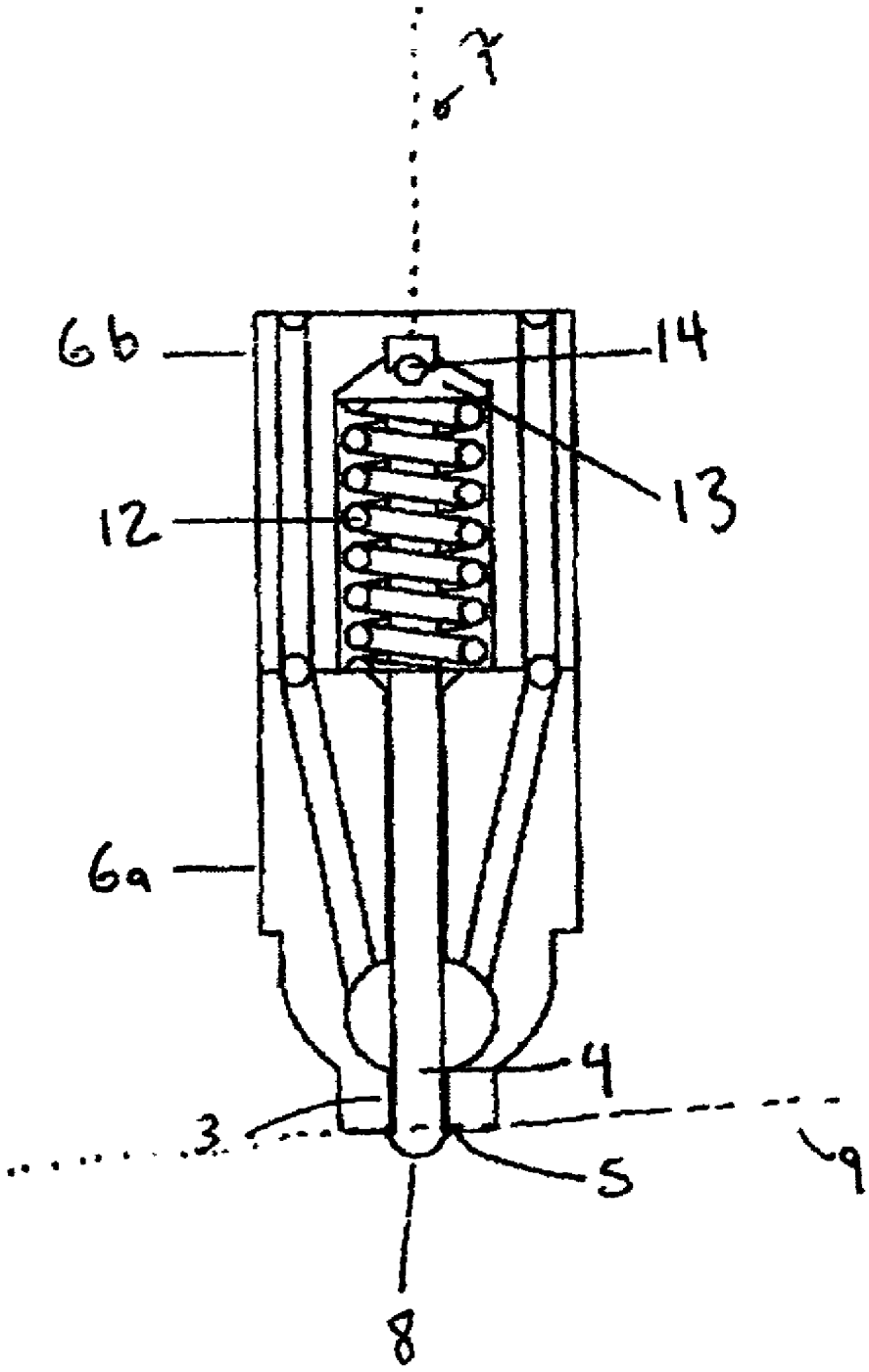
FIG. 2 depicts an embodiment of the present fuel injector nozzle assembly comprising the needle valve having a flanged portion extending through the valve outlet and beyond the exterior valve seat of the housing.

FIG. 2 depicts an embodiment of the present fuel nozzle injection assembly including a valve spring 12 as the biasing device. The valve spring configuration may further include a valve spring seat 13 and a locking device 14. However, any know biasing device, either mechanical or electrical may be used in the present assembly.

As illustrated, the nozzle body 6(*a-b*) may be formed from two parts including the spray tip housing 6*a* and the spring valve housing 6*b*. The nozzle body 6 defines a valve outlet 3 at the end of the nozzle body 6 adjacent to the combustion chamber 10. The nozzle body 6 further includes a horizontal axis 9.

A needle valve 4 is housed within and is aligned along the longitudinal axis 7 of the nozzle body 6. The needle valve 4 includes a first and second end wherein the first end is substantially contained within a cavity formed within the spring value housing 6*b* and the second end of the needle valve 4 is substantially housed within a cavity formed within the spray tip housing 6*a* of the nozzle body 6(*a-b*). The needle valve 4 further includes a flanged portion 8 which is located at the second end of the needle valve and is exposed to the combustion chamber 10. The flanged portion 8 of the needle valve 4 works in cooperation with the valve seat 5 to form a seal to regulate the injection of fuel into the combustion chamber 10. The valve seat 5 is located at the end of the valve opening 8 adjacent to the combustion chamber 10.

The needle valve 4 is slidably affixed within the nozzle body 6 such that the needle valve 4 may be raised or lowered within nozzle body 6. The movement of the needle value 4 is determined by the pressure of the fuel within the nozzle body 6 or spray tip housing 6*a*. The needle valve 4 moves down towards the combustion chamber 10 as the pressure builds within the spray tip housing 6*a*. Typically the needle valve 4 will move down or open when the pressure within the spray tip housing 6*a* reaches a psi of greater than 2,900.

Figure 3:
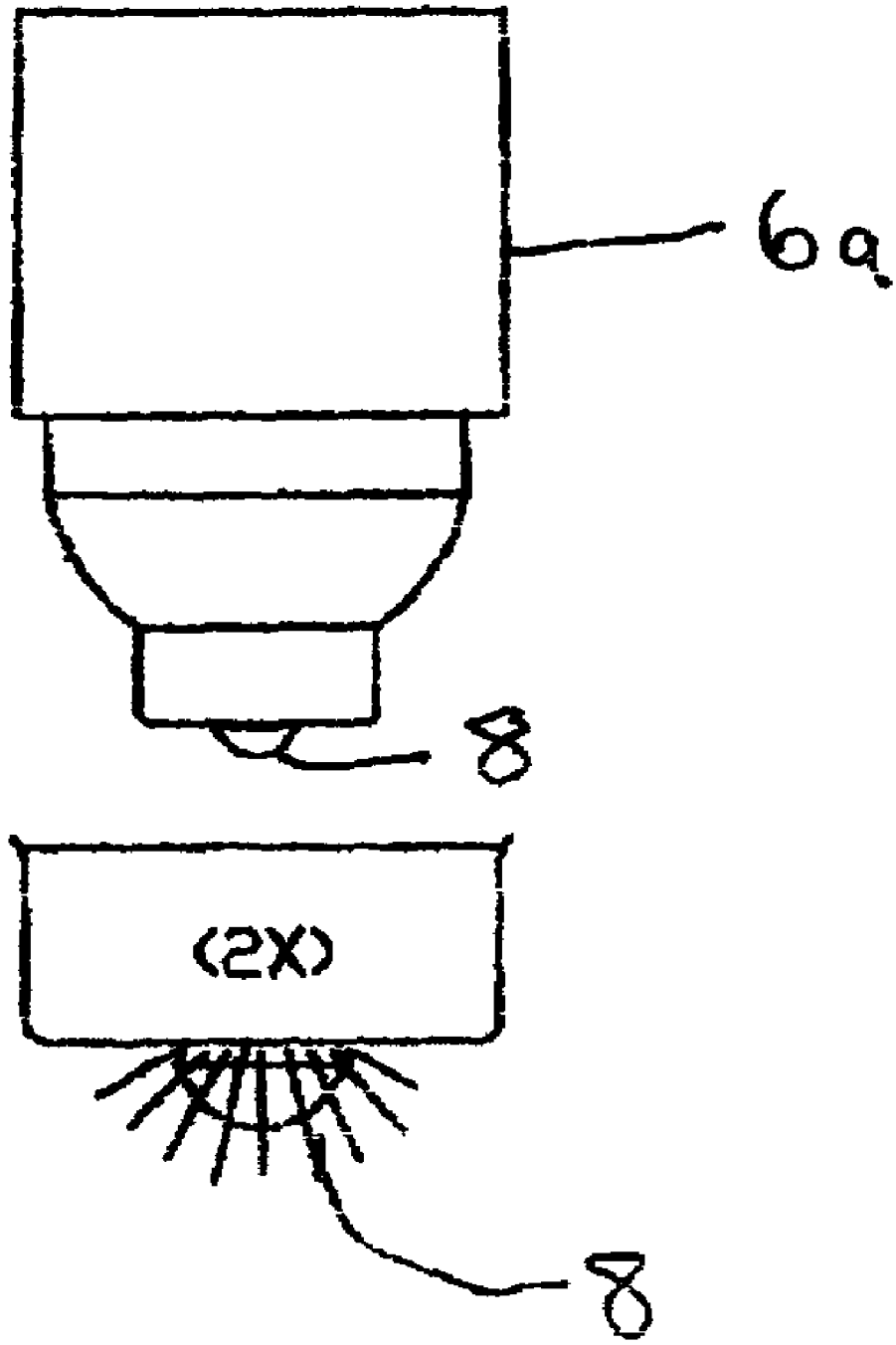
FIG. 3 illustrates a view of the flanged portion of the needle valve that extends into the combustion chamber, the flanged portion directs and atomizes the fuel plume into the combustion chamber.

FIG. 3 is a further view of the flanged portion 8 of the needle valve 4 that extends into the combustion chamber 10. As illustrated, fuel flows through the valve opening 3 and past the open needle valve 4 and over the flanged portion 8 as it exits the spray tip housing 6*a*. The flanged portion 8 may take on most any shape desired so long as the flanged portion 8 is able to direct the flow of fuel and seal the valve opening 3. As depicted in FIG. 3, the flanged portion 8 is dome shaped having curved surfaces or sloping edges that face the valve seat 5. The term "curved surfaces" and sloping edges" are used interchangeably herein and may mean either a curved or straight angled surface. The curved surface of the fanged portion 8 facing the valve seat 5 aids in directing the fuel into the combustion chamber 10 at a desired angle. By why of example and not by limitation, such a desired acute angle formed between the distal plane 9 and the directed fuel plume or stream may be 30°. Further examples of such fuel plume acute angles would include 45° from the distal plane 9, 60° from the distal plane 9, 75° from the distal plane and variations thereof.

Figure 4:
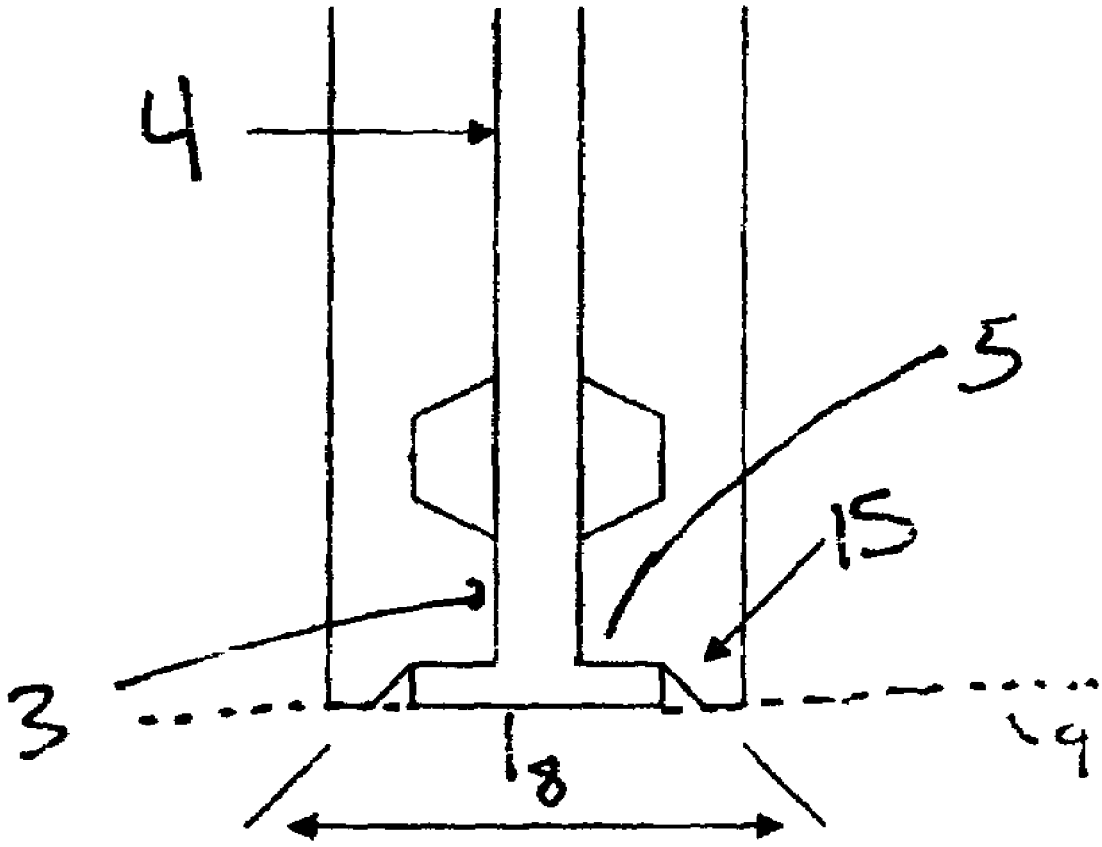
FIG. 4 depicts an embodiment of the present fuel injection nozzle assembly wherein the exterior valve seat includes a baffled portion for directing and atomizing a fuel plum into the combustion chamber whereby the spray pattern may be comprise a conical sheet.

FIG. 4 illustrates a further embodiment of the present fuel injection nozzle assembly wherein a baffling portion 15 is formed within the valve seat 5. The baffling portion 15 may take the form of sloping edges or curved surfaces. The baffling portion 15 also direct the fuel plume within the combustion chamber 10 in the same manner as the curved surface of the flanged portion 8 as is illustrated in FIG. 3. The same angle deflections would be applicable to the baffling portion 15 as would be to the curved surface of the flanged portion 8 of the needle valve 4. Additionally, the flanged portion 8 of the needle valve 4 is shown in a further configuration wherein the flanged portion is substantially parallel to the distal plane 9 for both the side adjacent to the valve seat 5 and the side adjacent to the combustion chamber 10. One advantage of the embodiment illustrated in FIG. 4, includes the ease of manufacturing and machining the parts.

Figure 5:
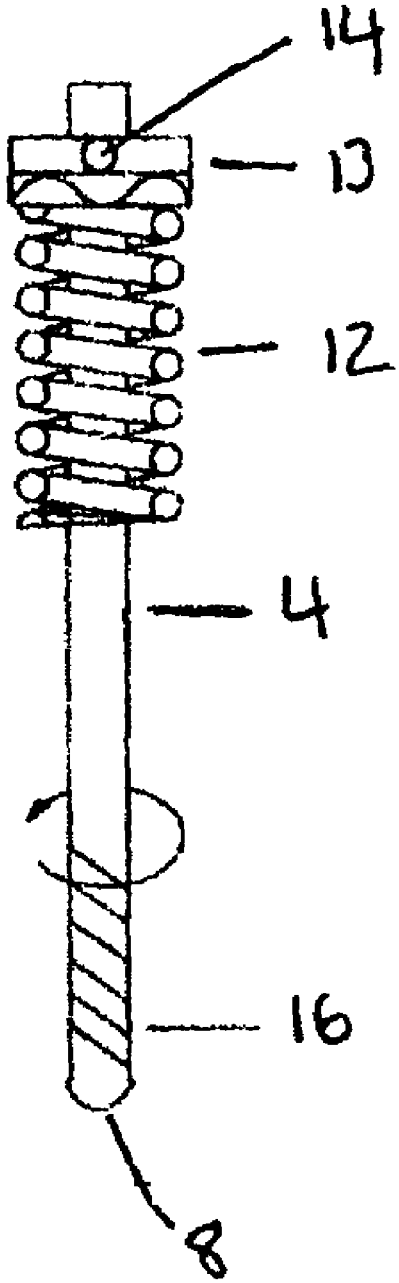
FIG. 5 illustrates an embodiment of the present spray nozzle assembly wherein the needle valve further includes indications or rifling groves for turning the needle valve to preserve even ware.

FIG. 5 illustrates an additional embodiment of the assembly wherein the needle value 4 further includes surface indications 16 about the outside circumference of the needle valve 4 for providing rotational motion as fuel passes down and along the needle valve 4. The surface indications 16 are grooves or ridges formed within or on the needle valve 4. The surface indications 16 act as rifling to impart rotational energy to the needle valve 4 each time an injection event occurs. The rotation movement of the needle valve 4 promotes even ware.

Figure 6:
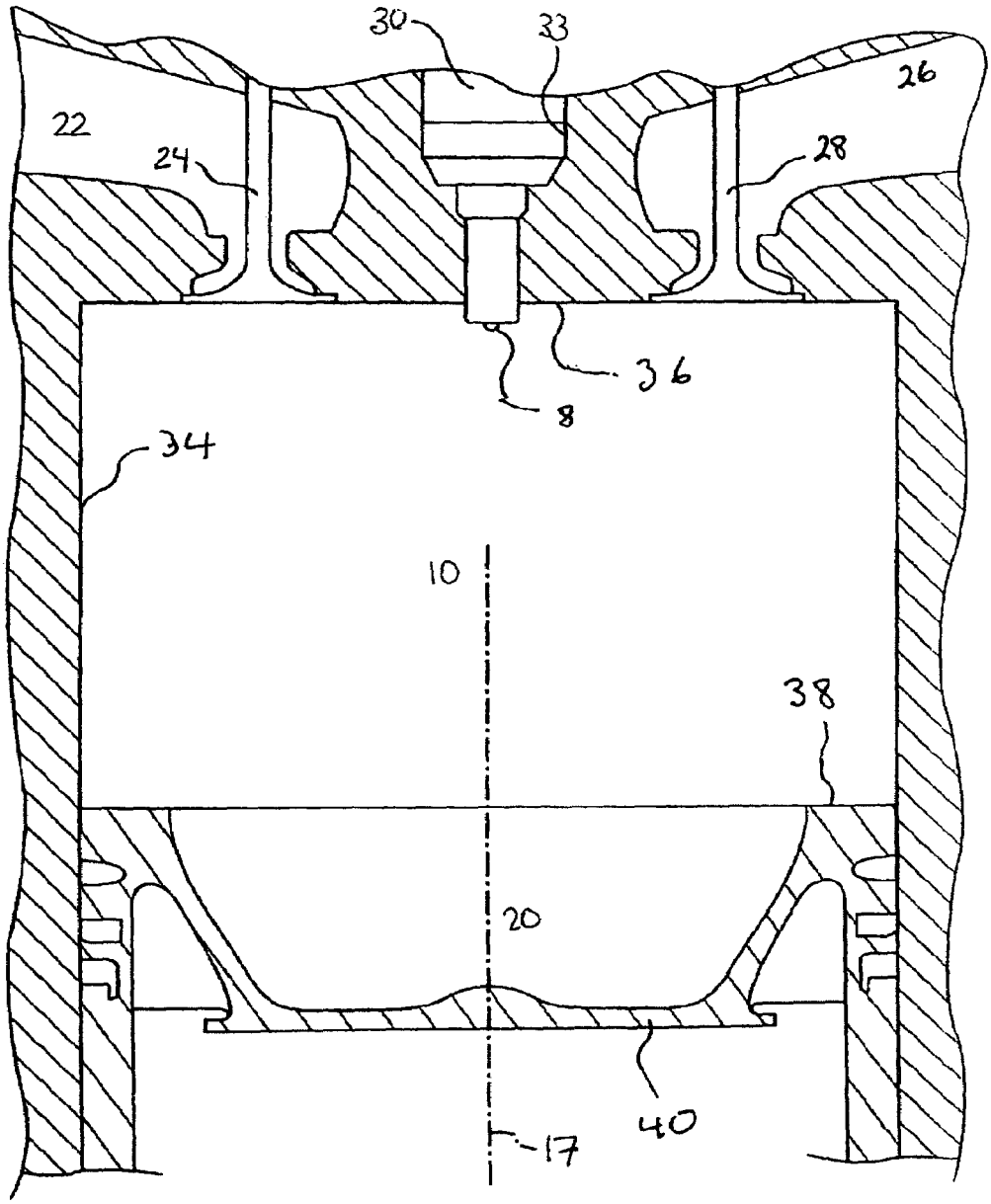
FIG. 6 is a cross-sectional view of a combustion chamber assembly of an internal combustion engine according to the disclosure.

FIG. 6 illustrates a combustion chamber 10 assembly of an internal combustion engine including a combustion chamber 10. Such an engine may include, for example, a four stroke diesel fuel powered engine. The combustion chamber 10 is formed by a cylinder sidewall 34, a cylinder end wall 36, and a reciprocating piston 16, and includes a combustion chamber longitudinal axis 17. The piston 16 may have a top surface 18 forming a piston crater 20. As is conventional in the art, an intake port 22, intake valve 24, exhaust port 26, and exhaust valve 28 may be located about the cylinder end wall 36.

A fuel injector 30 may include a flanged portion 8 extending directly into the combustion chamber 10 through an opening 33 in the cylinder end wall 36. The fuel injector 30 may be concentric or parallel with the longitudinal axis 17 of the combustion chamber 10 or may extend at an acute angle with respect to the longitudinal axis 17 of the combustion chamber. Further, the fuel injector 30 may be of any conventional type. For example, the fuel injector 30 may be of the mechanically actuated, hydraulically actuated, or common rail type, and may be designed for single mode or mixed mode operations.

While Applicants have set forth embodiments as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

The invention claimed is:

1. A fuel injector nozzle assembly for producing a conical fuel plume into a combustion chamber comprising:

a nozzle body defining a valve outlet including a valve seat and a longitudinal axis;

a needle valve having a first and second end, the needle valve slidably affixed and housed within the nozzle body about the longitudinal axis and the second end extending though the valve outlet and past the valve seat; and a flanged portion formed at the second end of the needle valve and in communication with the valve seat; and the flanged portion having a curved surface facing the valve seat, wherein the curved surface has an angular shape such that the curved surface directs the conical fuel plume into the combustion chamber at an angle between a distal plane and the fuel plume between 30 degrees and 75 degrees from the distal plane, furthermore the flanged portion of the needle value extending beyond the distal plane when in a closed postion.

2. The fuel injector nozzle assembly of claim 1, further including a biasing member attached to the first end of the need valve.

3. The fuel injector nozzle assembly of claim 2, wherein the biasing member includes a valve spring.

4. The fuel injector nozzle assembly of claim 1, further including a needle valve rotator cap operatively connected to the first end of the needle valve.

5. The fuel injector nozzle assembly of claim 1, further including surface indications about the outside circumference of the needle valve for providing rotational motion as fuel passes down and along the needle valve.

6. The fuel injector nozzle assembly of claim 1, wherein the flanged portion includes sloping edges adjacent to the valve seat for directing a fuel plume into a combustion chamber.

7. The fuel injector nozzle assembly of claim 1, wherein the flanged portion producing a circumferential spray pattern.

8. The fuel injector nozzle assembly of claim 1, wherein the valve seat includes sloping edges for directing a fuel plume.

9. A direct fuel injection combustion chamber assembly, comprising:

a combustions chamber;

a piston forming a moving end wall of the combustion chamber; and a fuel injector having a nozzle assembly communication with the combustion chamber, the nozzle assembly including, a nozzle body defining a valve outlet including a valve seat and a longitudinal axis;

a needle valve having a first and second end, the needle valve slidably affixed and housed within the nozzle body about the longitudinal axis and the second end extending though the valve outlet and past the valve seat;

a flanged portion formed at the second end of the needle valve and in communication with the valve seat and the flanged portion having a curved surface facing the valve seat, wherein the curved surface has an angular shape such that the curved surface directs a conical fuel plume into the combustion chamber at an angle between a distal plane and the fuel plume between 30 degrees and 75 degrees from the distal plane, furthermore the flanged portion of the needle value extending beyond the distal plane when in a closed position..

10. The direct fuel injection combustion chamber assembly of claim 9, further including a biasing member attached to the first end of the need valve.

11. The direct fuel injection combustion chamber assembly of claim 10, wherein the biasing member includes a valve spring.

12. The direct fuel injection combustion chamber assembly of claim 9, further including a needle valve rotator cap operatively connected to the first send of the needle valve.

13. The fuel direct fuel injection combustion chamber assembly of claim 9, further including surface indications about the outside circumference of the needle valve for providing rotational motion as fuel passes down and along the needle valve.

14. The direct fuel injection combustion chamber assembly of claim 9, wherein the flanged portion includes sloping edges for directing a fuel plume.

15. The fuel injector nozzle assembly of claim 9, wherein the flanged portion producing a circumferential spray pattern.

16. A method of injecting fuel into a combustion chamber comprising:

injecting fuel into a fuel injector nozzle assembly;

forming a gap between a flange portion of a needle valve and a valve seat formed on the exterior of a nozzle body, wherein the gap forms at a certain fuel pressure created by the injection of the fuel into the fuel injection nozzle assembly and wherein the flanged portion extends beyond a distal plane;

ejecting a quantity of fuel a circumferential spray pattern radiating out of the formed gap into the combustion chamber at an angle between the distal plane and the circumferential spray pattern between 30 degrees and 75 degrees from the distal plane; and closing the formed gap as the fuel pressure decreases.

17. The method of injecting fuel of claim 16, wherein the formed gap closes prior to the ignition of the fuel.

18. The method of injecting fuel of claim 16, wherein fuel is injected into the combustion chamber at a predetermined angle.

19. The method of injecting fuel of claim 16, wherein the certain fuel pressure opening the gap is greater than 2900 psi.

20. The method of injecting fuel of claim 16, further including rotating the needle valve.

* * * * *